US005873339A

United States Patent [19]

Isogai

[11] Patent Number: 5,873,339

[45] Date of Patent: Feb. 23, 1999

[54] BIDIRECTIONALLY RECIPROCATING PISTON ENGINE

[76] Inventor: Daikichiro Isogai, 13-1-405, Okura 1-chome Yahatahigashi-ku, Kitakyushu-shi, Fukuoka-ken, 805, Japan

[21] Appl. No.: 871,777

[22] Filed: Jun. 9, 1997

[30] Foreign Application Priority Data

Aug. 13, 1996 [JP] Japan ..... 8-232604

[51] Int. Cl.[6] ..... F02B 75/24

[52] U.S. Cl. ..... 123/197.4

[58] Field of Search ..... 123/197.4, 54.1, 123/53.6

[56] References Cited

U.S. PATENT DOCUMENTS

| | | | |
|---|---|---|---|
| 4,491,097 | 1/1985 | Hamann | 123/197.4 |
| 4,512,290 | 4/1985 | Ficht et al. | 123/197.444 |
| 4,512,291 | 4/1985 | Kirk | 123/197.4 |
| 4,584,972 | 4/1986 | Jayne et al. | 123/197.4 |
| 4,598,672 | 7/1986 | Jayne et al. | 123/197.4 |
| 4,776,310 | 10/1988 | Gray | 123/197.4 |
| 4,791,898 | 12/1988 | Jayne | 123/197.4 |
| 4,884,536 | 12/1989 | Neale et al. | 123/197.4 |
| 5,131,353 | 7/1992 | Bauer et al. | 123/197.4 |
| 5,327,863 | 7/1994 | Downton et al. | 123/197.4 |
| 5,494,135 | 2/1996 | Brackett | 123/197.4 |

FOREIGN PATENT DOCUMENTS

| | | |
|---|---|---|
| 55-84801 | 6/1980 | Japan . |
| 58-135301 | 8/1983 | Japan . |

*Primary Examiner*—David A. Okonsky
*Attorney, Agent, or Firm*—Pollock, Vande Sande & Amernick

[57] ABSTRACT

The present invention relates to a bidirectionally reciprocating piston engine comprising (a) a cylinder block having a cylinder and a crankcase formed at the base of the cylinder, (b) a bidirectional type piston body having a piston accommodated in each of the cylinders of the cylinder blocks disposed opposite to each other with the axial line of the piston body coincident with that of the cylinders, an arm at the base of the piston, and a long hole-like crank drive part which is formed at the central part of the arm, (c) a rotating slider slidably disposed in the crank drive part; and (d) a crankshaft having a crank pin to which the rotating slider is rotatably attached, wherein since two pistons are coaxially disposed at one crank pin, the vibration is suppressed, the running noise is remarkably low and the load onto the crankshaft may be remarkably lowered, and in which the productivity thereof is excellent with a limited number of parts and the mass production thereof can be carried out at a low production cost.

8 Claims, 11 Drawing Sheets

FIG. 4
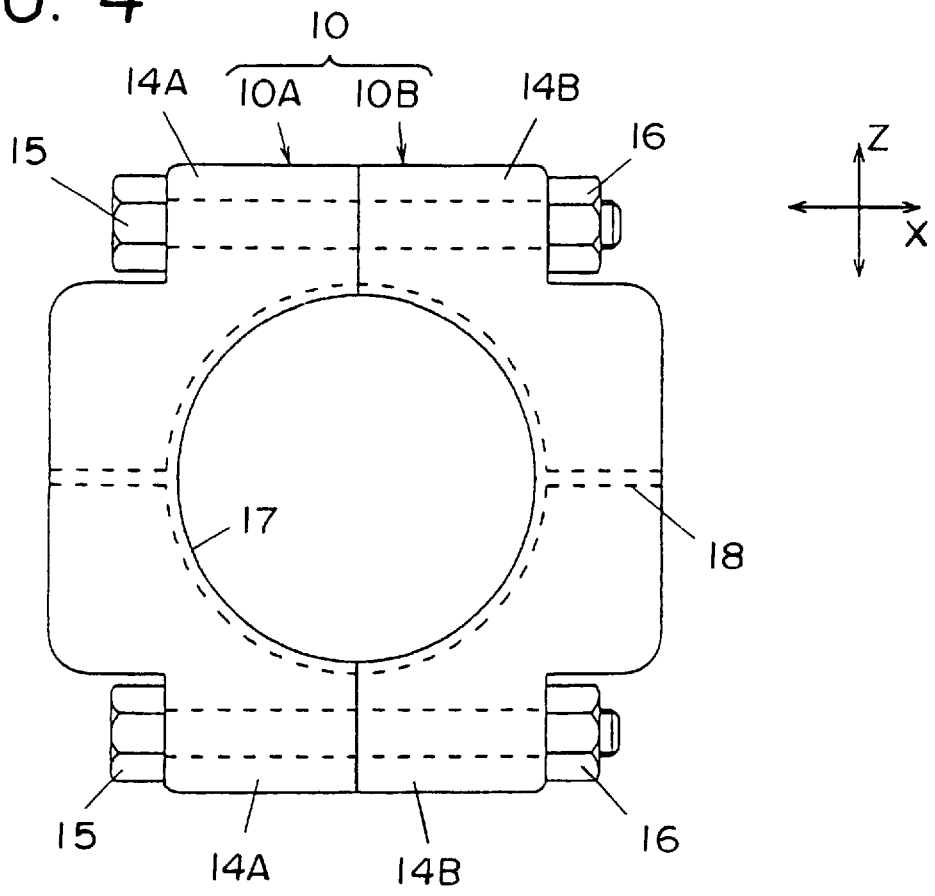
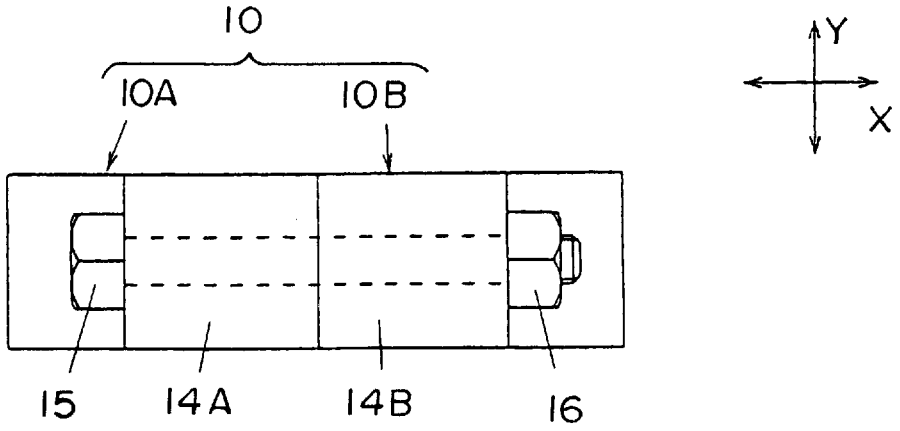
FIG. 5

BIDIRECTIONALLY RECIPROCATING PISTON ENGINE

FIELD OF THE INVENTION

The present invention relates to a bidirectionally reciprocating piston engine which is able to convert reciprocations of a piston to rotational motions of a crankshaft.

DESCRIPTION OF PRIOR ARTS

Conventionally, an internal combustion engine has been placed in various ideas of intending to increase the output thereof. As a method to increase the output, there is a method by which the number of pistons is increased. However, this method has a shortcoming by which an internal combustion engine is made large-sized. As a method to increase the number of pistons without elongating the crank shaft, a V-8 engine has been developed, in which two pistons are attached to one crank pin.

However, since such a V-8 engine has a connecting rod which connects a piston and a crankshaft to each other, the structure thereof is complicated and needs a number of components, which is not suitable for increasing the productivity thereof. Furthermore, the piston motions have harmonic components in addition to the fundamental frequency while an internal combustion engine is running. Especially, in a vehicle, there is such a problem where the vehicle body vibration and/or roaring noise in a passenger cabin may arise.

Therefore, as a method to solve the abovementioned problem, Japanese laid-open patent publication Nos. 84801 of 1980 and 135301 of 1983 are disclosed. A piston-crank device which is able to prevent vibrations having harmonic components by disposing a slider, into which a crank pin is inserted, in a long hole formed on the arm was disclosed by Japanese laid-open patent publication No. 84801 of 1980.

In Japanese laid-open patent publication No. 135301 of 1983 which was previously filed by the present applicant, a reciprocating piston engine was disclosed, in which a guide having a crank pin inserted is slidably attached to the rail-shaped part secured at the piston base to make fixed the distance from the center of the piston pin to the piston top along the piston motion direction, thereby the rotational components of the crank are directly converted to reciprocatory motions without using any connecting rod.

However, with the abovementioned construction, since only one piston may be provided at a crank pin, the crankshaft may be elongated in a case where multicylinders are employed to increase the output. That is, there is still a problem in that the piston engine is large-sized in the direction of the crankshaft. Furthermore, since a gas explosion occurs at one point against a long crankshaft, vibrations arise at the crankshaft. Therefore, the longer the crankshaft becomes, the greater the vibrations become. In line with increasing the output and displacement, a critical problem may arise with respect to the crankshaft.

In order to solve these problems, several ways can be considered,for example, the diameter of the crankshaft is made large, a material having a high rigidity and a high wearing resistance is selected, and bearings are employed at each of the cylinders. However, in this case, the number of bearings will be remarkably increased, simultaneously resulting in an increase of the mechanical loss at the bearings. Accordingly, there arises another problem where the durability thereof may be lost, and still another problem may arise in that a thermal countermeasure at the top of the piston pins becomes complicated.

SUMMARY OF THE INVENTION

The present invention is to solve the abovementioned conventional problems. It is therefore an object of the invention to provide a bidirectionally reciprocating piston engine in which, since two pistons are coaxially disposed at one crank pin, the vibration is suppressed, the running noise is remarkably low and the load onto the crankshaft may be remarkably lowered and which is excellent in the productivity thereof with a limited number of parts and can be mass-produced at a low production cost.

A bidirectionally reciprocating piston engine according to the invention comprises (a) a cylinder block having a cylinder and a crankcase formed at the base of the cylinder, (b) a bidirectional type piston body having a piston accommodated in each of the cylinders of the cylinder blocks disposed opposite to each other with the axial line of the piston body coincident with that of the cylinders, an arm at the base of the piston, and a long hole-like crank drive part which is formed at the central part of the arm, (c) a rotating slider slidably disposed in the crank drive part; and (d) a crankshaft having a crank pin to which the rotating slider is rotatably attached.

With this construction, the bidirectional piston body is able to convert the reciprocations of piston to the rotational motions of a crankshaft in the cylinders opposed each other with the axial centers coincident with each other via a rotating slider disposed at the crank drive part. The piston motions do not contain any harmonic components but have only the fundamental frequency, thereby causing the vibrations to be greatly lowered. Furthermore, since no connecting rod nor piston pin is required, the number of parts is able to be suppressed.

Since two pistons may be mounted per crank pin, the length of the crankshaft can be made short, and simultaneously the displacement of an internal combustion engine can be increased with the number of parts limited. Furthermore, since no piston pin is required, it becomes easy to make a thermal countermeasure against the top of pistons. Therefore, a bidirectionally reciprocating piston engine according to the invention will be suitable as an engine for vessels and co-generation plants which need a large displacement. Still furthermore, since the pistons are made free from any biased motion, the stress applied onto the bore of the cylinders will be remarkably weakened.

By pistons horizontally disposed, it is possible to suppress the height of an internal combustion engine. In a case where a bidirectionally reciprocating piston engine according to the invention is applied to a multicylinder engine such as an 8-cylinder bidirectionally reciprocating piston engine, etc., a completely dynamic balance can be secured, and the explosion force is simultaneously caused to act on the crankshaft as a couple from two bidirectional piston bodies, thereby causing the mechanical loss of the bearing part to be decreased. Therefore, it is advantageous in view of increasing the durability.

The abovementioned and other objects, features and advantages of the present invention will become more apparent by reference to the following description of preferred embodiments of the invention taken in conjunction with the accompanying drawings.

BRIEF DESCRIPTION OF THE DRAWINGS

In the accompanying drawings:

FIG. 4 is a front elevational view of a rotating slider;

FIG. 5 is a plan view of the rotating slider;

DESCRIPTION OF THE PREFERRED EMBODIMENTS

Figure 1:
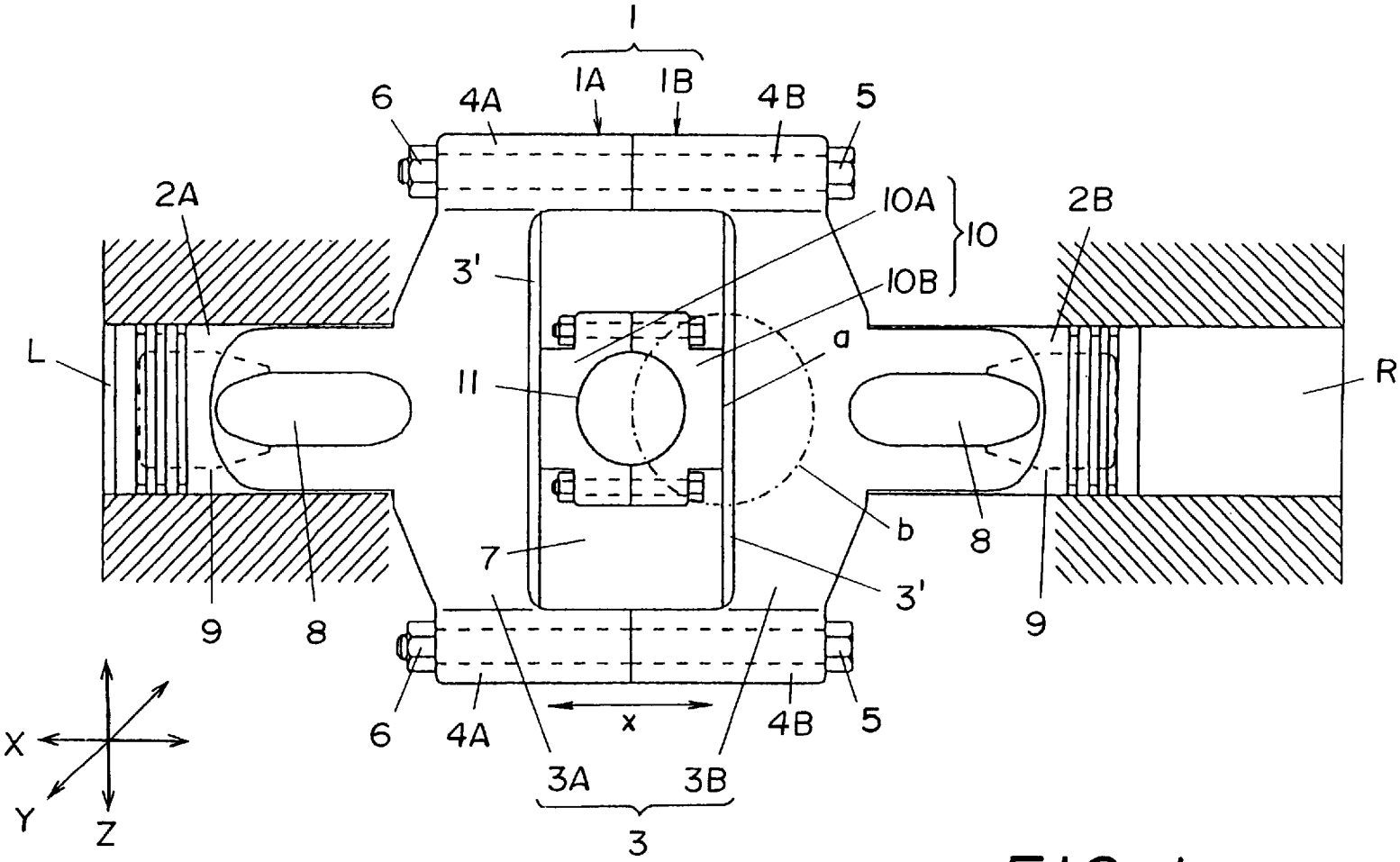
FIG. 1 is a front elevational view of a bidirectional type piston body of a bidirectional type piston engine according to the first preferred embodiment of the invention.

A bidirectionally reciprocating piston engine according to the invention has (a) a cylinder block having a cylinder and a crankcase formed at the base of the cylinder, (b) a bidirectional type piston body having a piston accommodated in each of the cylinders of the cylinder blocks disposed opposite to each other with the axial line of the piston body coincident with that of the cylinders, an arm at the base of the piston, and a long hole-like crank drive part which is formed at the central part of the arm, (c) a rotating slider slidably disposed in the crank drive part; and (d) a crankshaft having a crank pin to which the rotating slider is rotatably attached.

With this construction, when fuel gas is exploded at one cylinder to push the piston and the bidirectional piston body is moved to the other cylinder side opposite thereto, a rotating slider attached to the crank pin is caused to rotate along its rotating locus centering around the axial line of the crankshaft while sliding the long-hole like crank drive part, whereby the crankshaft is rotated in line with the rotation of the rotating slider. Furthermore, fuel gas is compressed by the other piston of the other cylinder in line with the motion of the bidirectional piston body. Continuously, the bidirectional piston body is moved to one cylinder side by the fuel gas explosion in the other cylinder, whereby similarly the rotating slider attached to the crank pin causes the crankshaft to rotate while reciprocating in the crank drive part. Accordingly, a rotational force is given to the crankshaft by these motions being continuously performed.

Herein, the piston and arm part may be made integral with each other, and they may be connected to each other by using a connecting pin, etc. Since a bidirectionally reciprocating piston engine according to the invention is configured as described above, the piston engine may be applicable to not only an internal combustion engine, but also, for example, an external combustion engine such as a steam engine or compressor.

A bidirectionally reciprocating piston engine according to the invention is further constructed so that the bidirectional piston body is formed of a pair of part piston bodies divided at the arm part.

With this construction, it is easy to manufacture the piston engine even in a case where the bidirectional piston body is made large-sized. Furthermore, a freedom of designing can be increased, whereby it is possible to select a suitable material with respect to the respective parts in response to the mechanical stress thereof.

A bidirectionally reciprocating piston engine according to the invention is still further constructed so that the cylinder blocks disposed opposite to each other are connected together via a pair of engine beds having the bearing part of the crankshaft.

With this construction, it is possible to change the material of the cylinder block to, for example, a light aluminum material which is different from that of the engine bed. Therefore, it is advantageous in view of lightening the engine weight.

A bidirectionally reciprocating piston engine according to the invention is also constructed so that the phase of at least one crank pin adjacent to one crank pin has a configuration different 180° (degrees) from the abovementioned one crank pin.

With this construction, since it is possible that explosion is caused to simultaneously occur at cylinders opposite to each other in the adjacent bidirectional piston bodies, impact applied to the bearing at the time of explosion can be counterbalanced.

Preferred embodiments of the invention will be described with reference to the accompanying drawings.

(First preferred embodiment)

Figure 2:
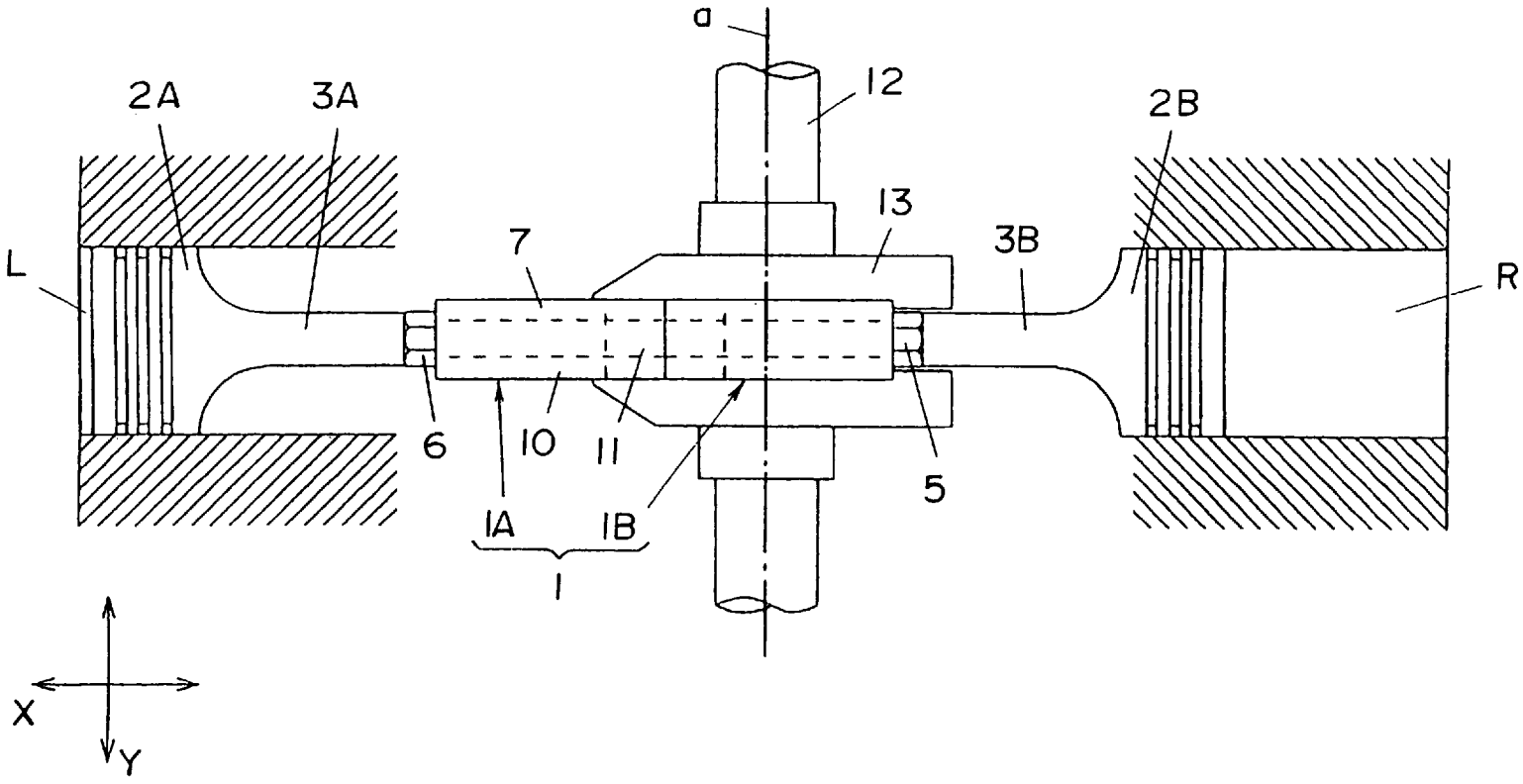
FIG. 2 is a plan view of the bidirectional type piston body.
Figure 3:
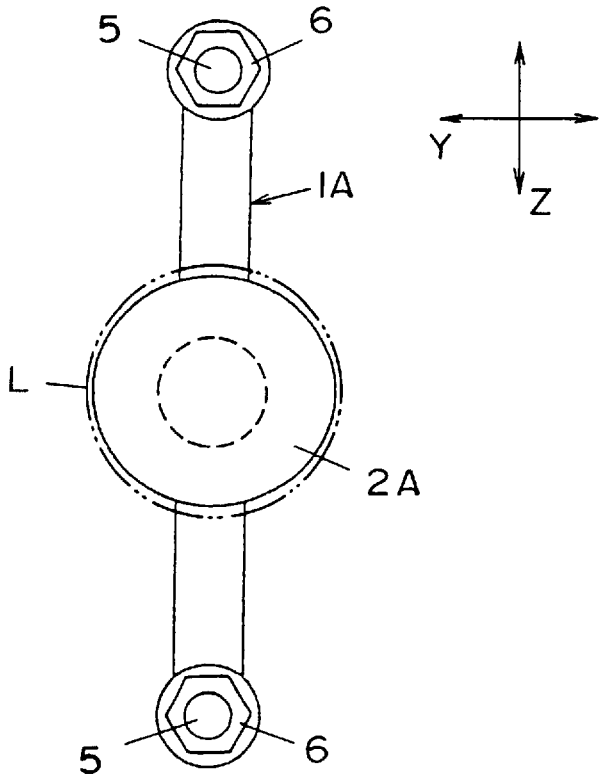
FIG. 3 is a side elevational view of the bidirectional type piston body.

FIG. 1 is a front elevational view of a bidirectional piston body of a bidirectionally reciprocating piston engine according to the first preferred embodiment of the invention. FIG. 2 is a plan view of the bidirectional piston body. FIG. 3 is a side elevational view of the bidirectional piston body. In these drawings, the travelling direction of the piston is made "X direction", the axial line direction of the crankshaft orthogonal to the X direction is made "Y direction", and the travelling direction of a rotating slider is made "Z direction".

1 is a bidirectional piston body. 1A and 1B are a part piston body which forms the bidirectional piston body 1. 2A and 2B are a piston of the part piston bodies 1A and 1B. 3 is an arm part formed at the base of the pistons 2A,2B. 3A and 3B are a part arm which forms the arm part 3. 3' is a sliding surface of the arm part 3. 4A and 4B are a connection part which is formed at both sides of the part arms 3A and 3B and connects the part piston bodies 1A and 1B to each other. 5 is a bolt which is inserted into the connection part 4A or 4B and is used for connecting them together. 6 is a nut which connects the part piston bodies 1A and 1B by a bolt-nut structure with the part piston body 1A brought face to face with the part piston body 1B. 7 is a long hole-like crank drive part formed by the part arms 3A and 3B when the part piston bodies 1A and 1B are connected to each other. 8 and 9 are a cut-away part formed at the part piston bodies 1A and 1B. 10 is a rotating slider disposed at the crank drive part 7. 10A and 10B are a part slider which constitutes the rotating slider 10. 11 is a crank pin to which the rotating slider 10 is rotatably attached. 12 is a crankshaft. 13 is a crank arm. L and R are cylinders which are disposed opposite to each other and have pistons 2A and 2B rectilinearly accommodated therein. a is the axial line of the crankshaft 12 and b is a rotating locus along which the rotating slider 10 rotates centering around the axial line a.

Next, a description will be given below of a rotating slider according to the first preferred embodiment with reference to the accompanying drawings.

FIG. 4 is a front elevational view of the rotating slider according to the first preferred embodiment, and FIG. 5 is a plan view of the rotating slider.

10 is a rotating slider. 10A and 10B are part rotating sliders. 14A and 14B are a connection part which connects the part sliders 10A and 10B to each other. 15 is a bolt which is inserted into the connection parts 14A and 14B for connection thereof. 16 is a nut which connects part sliders 10A and 10B together by a bolt-nut structure with the part slider 10A brought face to face with the part slider 10B and forms the rotating slider 10. 17 is an insertion hole of the crank pin 11. 18 is an oil flow path through which lubrication oil is supplied to the insertion hole 17 of the crank pin 11.

Furthermore, although the first preferred embodiment is such that the part piston body is connected to the part slider by a bolt-nut structure, a generally known method such as fitting may be employed instead. Furthermore, the following may be employed, that is, the sliding surface between the rotating slider and the arm is curved in order to prevent a rotational sway of the center axis of the bidirectional piston body, or a guide part is formed at the cylinder block and engine bed, and an engaging part which is engaged with the guide part may be formed at the part piston body.

Next, a description will be given below of the motions of an internal combustion engine, in which pistons are disposed opposite to each other, according to the first preferred embodiment.

As shown in FIG. 1 or FIG. 2, as fuel gas is exploded in the cylinder L, the piston 2A is pushed to thereby cause the corresponding piston body 1 to move toward the cylinder R. At this time, the rotating slider 10 moves along the rotating locus b centering around the axial line a of the crankshaft 12 while rotating the crank pin 11, whereby the inside of the crank drive part 7 is reciprocated in the direction of the arrow Z. Furthermore, at the cylinder R side when fuel gas is exploded in the cylinder L, fuel gas is compressed by the piston 2B, and consecutively fuel gas is exploded in the cylinder R to thereby cause the piston 2B to be pushed and cause the corresponding piston body 1 to move toward the cylinder L. Similarly, the rotating slider 10 causes the inside of the crank drive part 7 to reciprocate in the direction of the arrow Z while rotating the crank pin 11. Thereafter, these motions are continuously carried out, whereby a rotating force is given to the crankshaft 12.

As described above, since the bidirectional piston body is caused to reciprocate between both cylinders via a rotating slider attached to the crank pin and disposed at the crank drive part formed of part arms, rectilinear motions are converted to rotating motions of the crankshaft. Therefore, since the piston motions only include the fundamental frequency but do not have any harmonic components, it is possible to prevent vibrations and noise from arising. Still furthermore, since the two pistons simultaneously receive pressure applied to the side wall of the cylinders, the pressure applied to the side wall of the cylinders can be decreased to a large extent, whereby it is advantageous in view of a lowering of the damage of the peripheral wall of cylinders.

Furthermore, in comparison with a conventional internal combustion engine in which a connecting rod is used, the number of pistons can be doubled with respect to the crankshaft of the same specification, whereby the displacement of the internal combustion engine can be increased. Still furthermore, when it comes to the same displacement, the diameter and stroke of pistons can be further decreased than the conventional pistons. Therefore, the crankshaft can be small-sized, and this contributes to a downsizing of an internal combustion engine.

Furthermore, in comparison with conventional opposed cylinder type internal combustion engine, no connecting rod nor piston pin is required. Therefore, the entire system thereof is lightened to cause the number of components to be decreased. Accordingly, the production cost can be decreased.

Since no conventional piston pin is required in the respective pistons, it is easy to make a thermal countermeasure at the piston tops, and since it is possible to horizontally install the pistons, it is very advantageous to lower the height of the internal combustion engine.

Still furthermore, with respect to gas sealing and lubrication which are important factors in an internal combustion engine, a bidirectionally reciprocating piston engine according to the invention has functions equivalent to those of a conventional opposed cylinder type internal combustion engine, and at the same time since the relative speed between the slideway of the arm part and the rotating slider is equivalent to the relative speed between a conventional connecting rod and crank pin, the conventional technology for lubrication can be applicable thereto.

The heat discharge of the crankcase can be carried out by the same method as the conventional method by which oil is discharged into an oil bath.

(Second preferred embodiment)

A description will be given of a bidirectionally reciprocating piston engine according to the second preferred embodiment of the invention, which is applied to a V-8 cylinder internal combustion engine.

Figure 6:
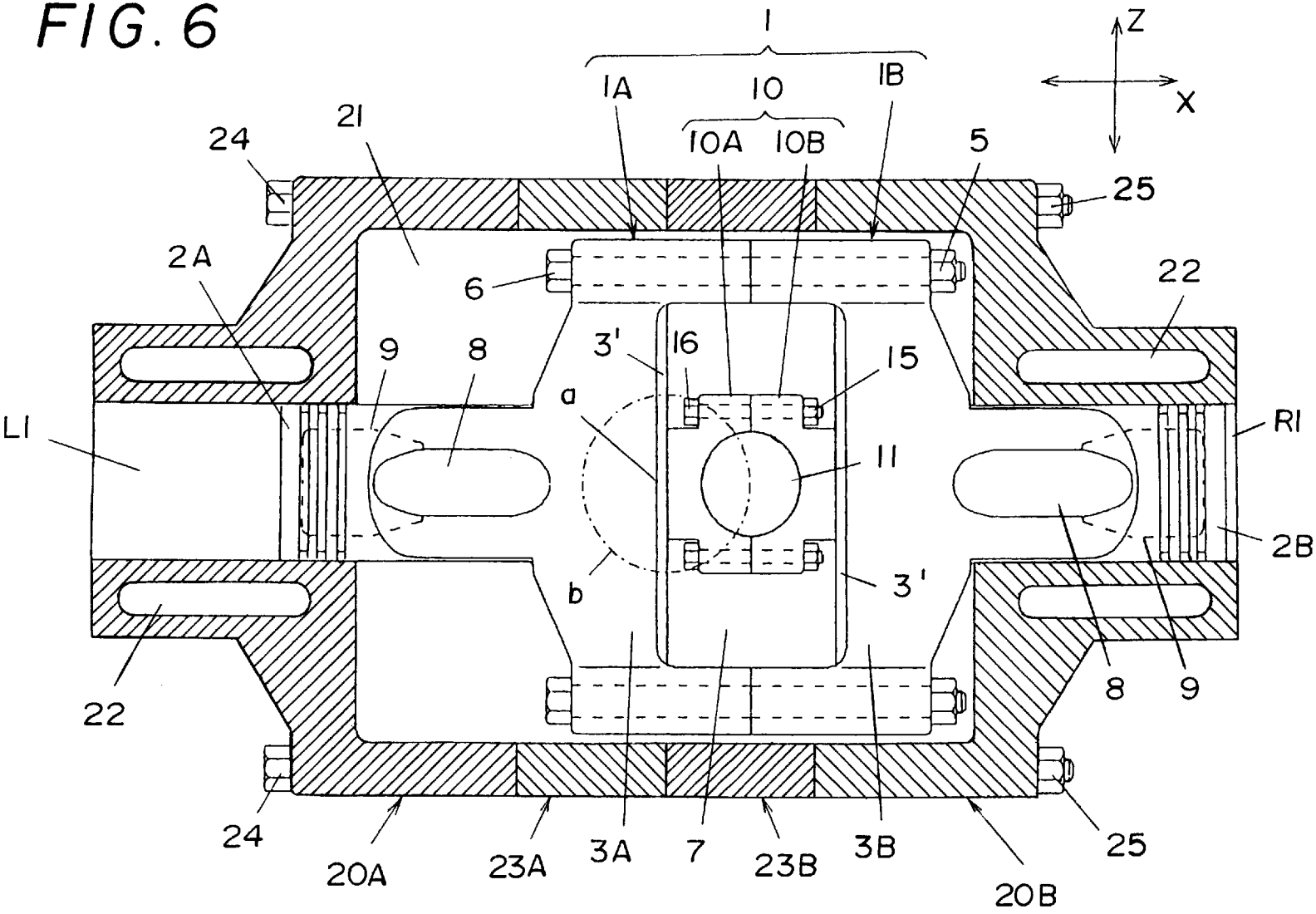
FIG. 6 is a front sectional view of an 8-cylinder bidirectionally reciprocating piston engine according to the second preferred embodiment of the invention.
Figure 7:
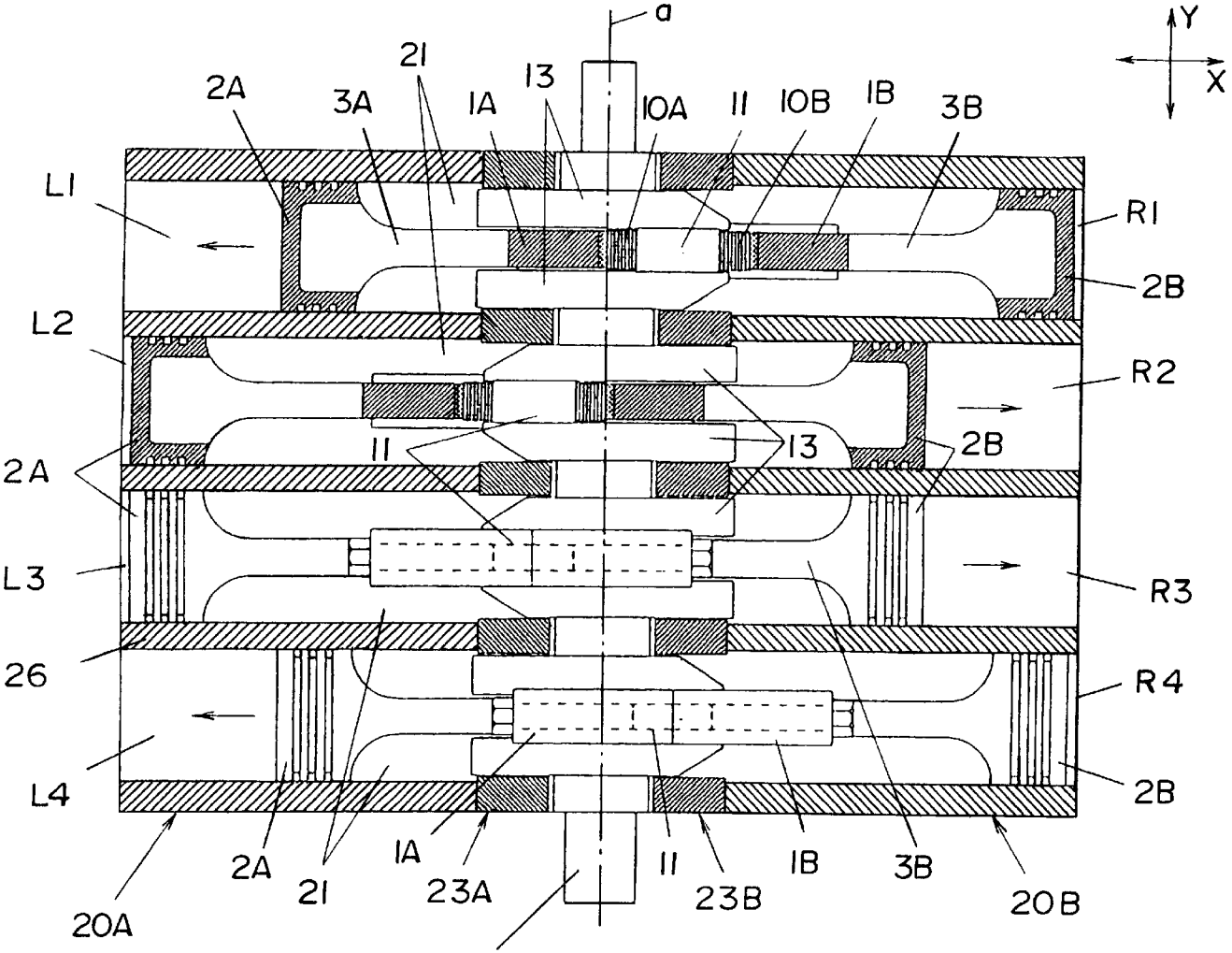
FIG. 7 is a horizontal sectional view of the 8-cylinder bidirectional piston engine.
Figure 8:
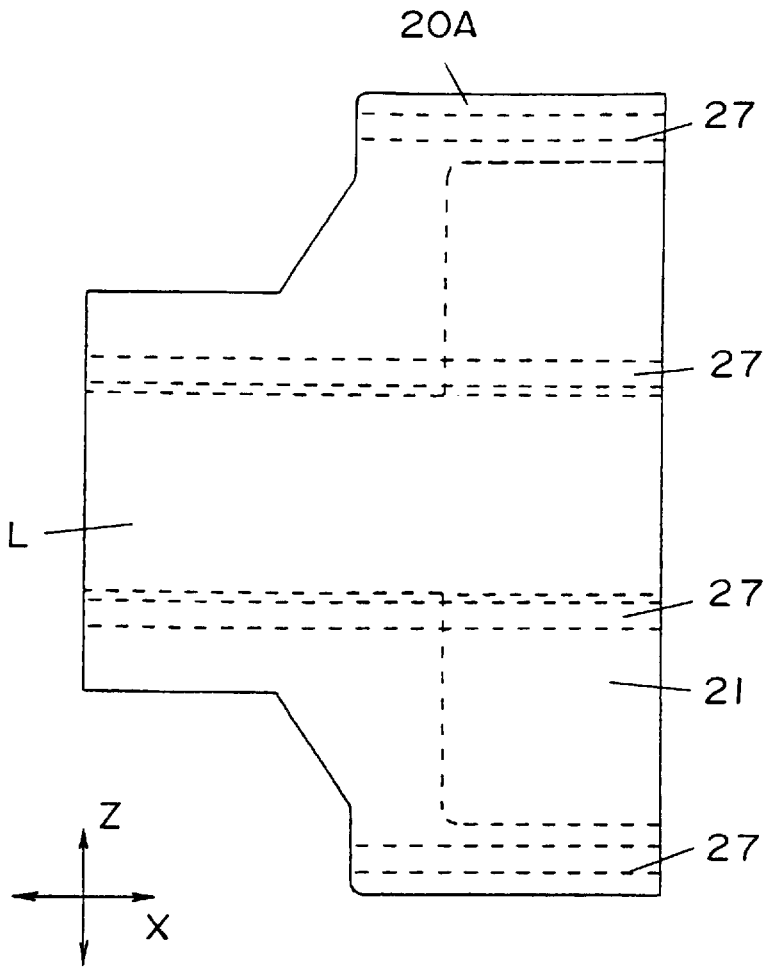
FIG. 8 is a front elevational view of a cylinder block.
Figure 9:
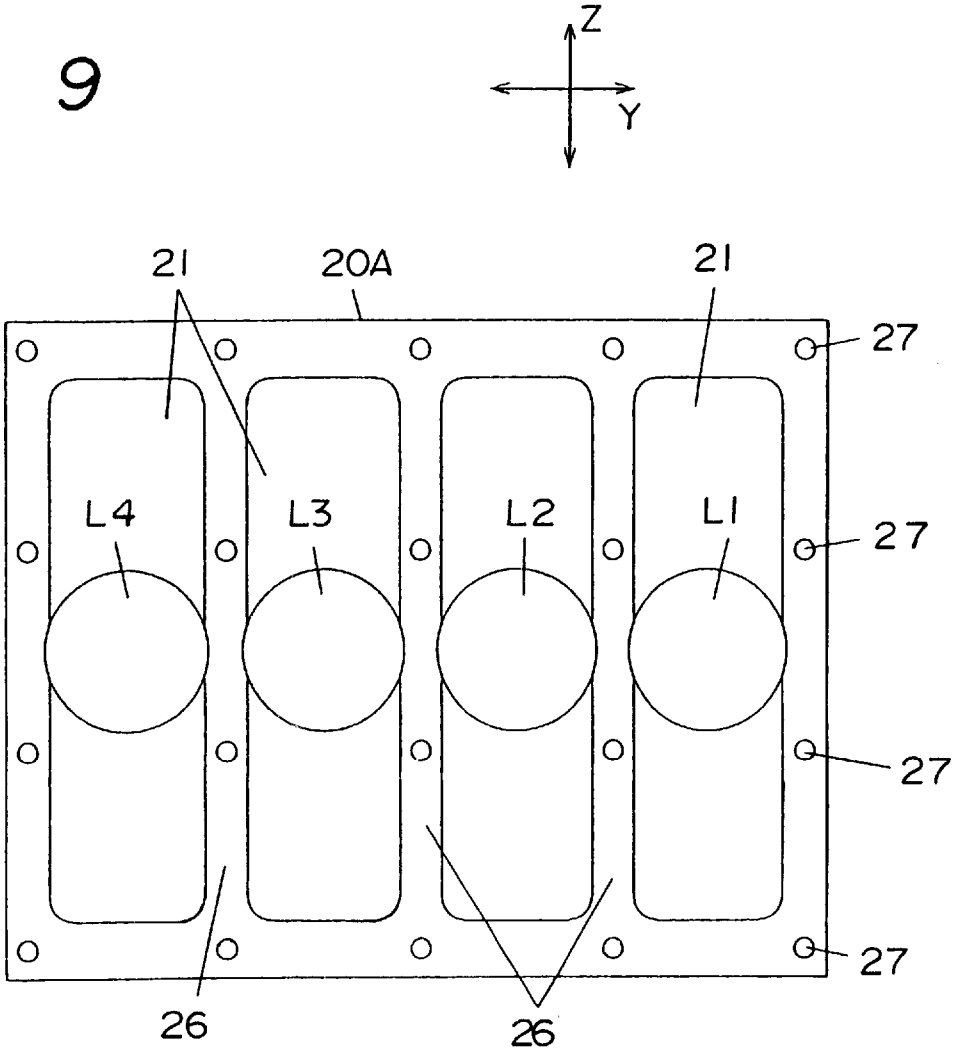
FIG. 9 is an end view showing the inside of the cylinder block.
Figure 10:
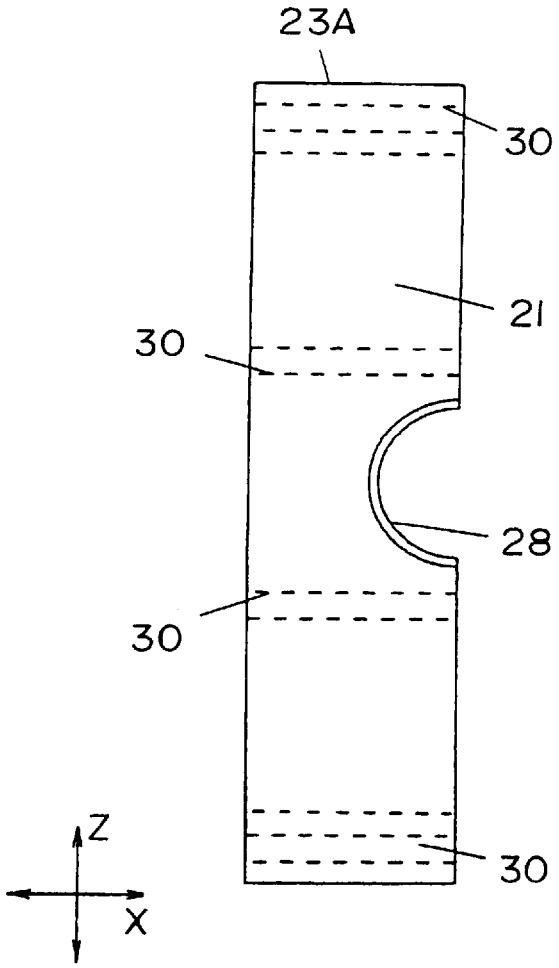
FIG. 10 is a front elevational view of an engine bed.
Figure 11:
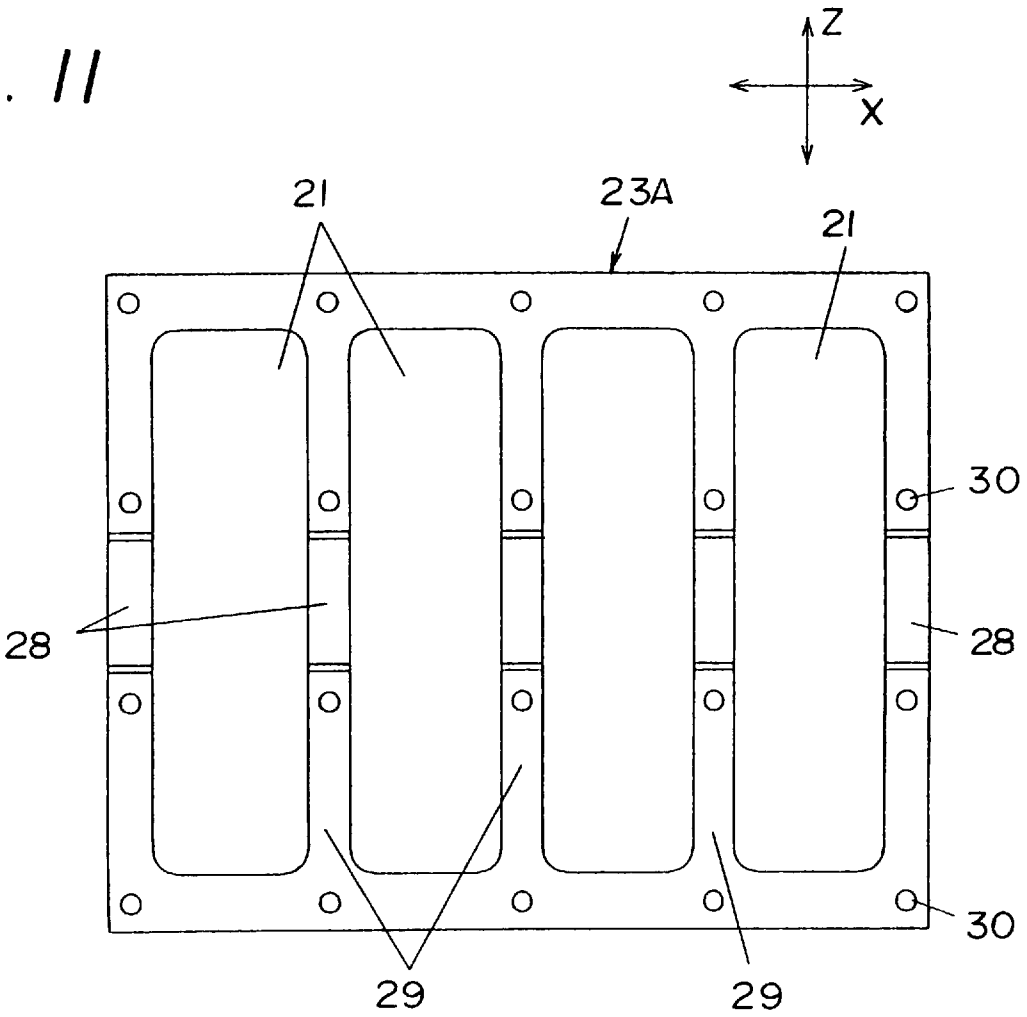
FIG. 11 is an end view showing the inside of the engine bed.
Figure 12:
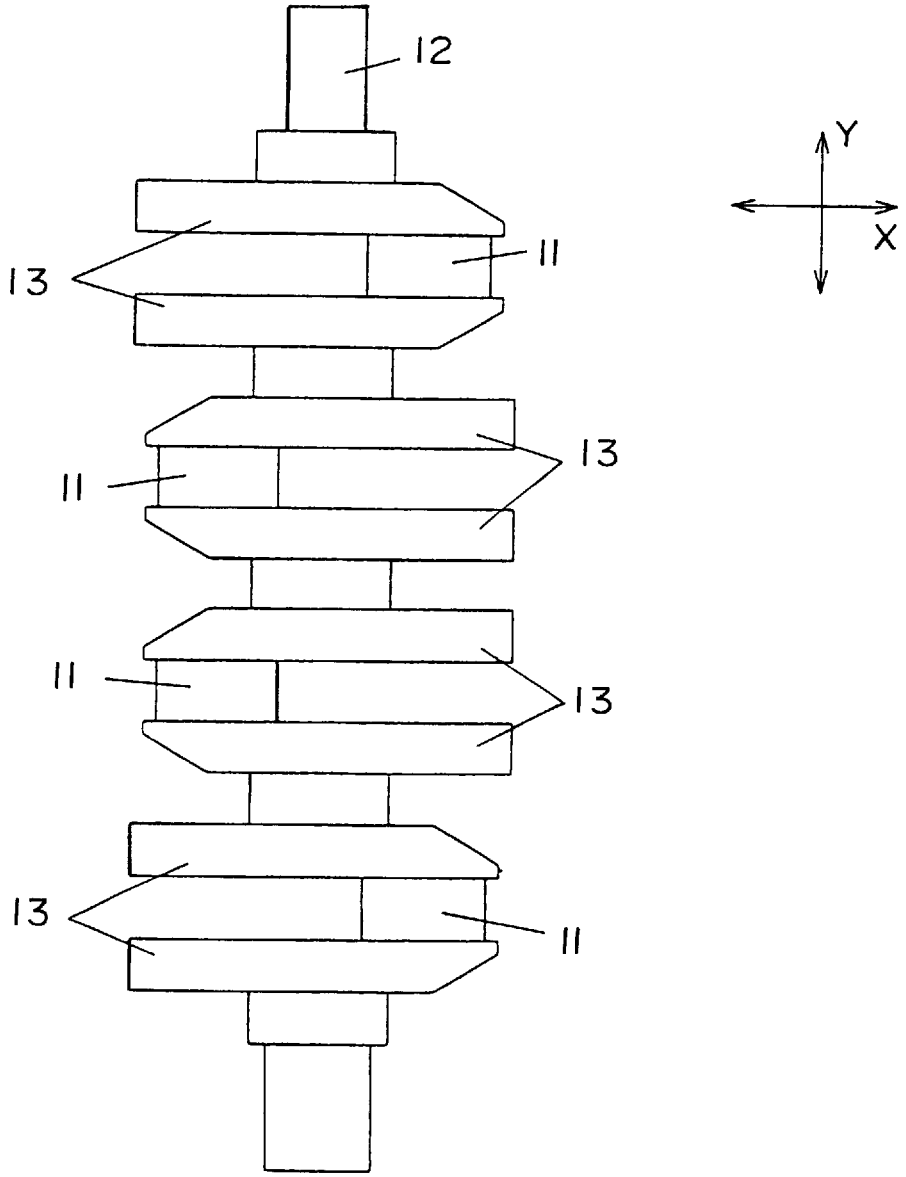
FIG. 12 is a plan view of a crankshaft

FIG. 6 is a front sectional view of an 8-cylinder bidirectionally reciprocating piston engine according to the second preferred embodiment of the invention, FIG. 7 is a plan sectional view of an 8-cylinder bidirectional type piston engine, FIG. 8 is a front elevational view of a cylinder block, FIG. 9 is a view showing the inside end of the cylinder block, FIG. 10 is a front elevational view of the engine bed, FIG. 11 is a view showing the inside end of the engine bed, and FIG. 12 is a plan view of a crankshaft. The parts which are identical to those in the first preferred embodiment are given the same reference numbers, and the description thereof is omitted.

In FIG. 6 or FIG. 7, 20A and 20B are a pair of cylinder blocks. 21 is a crankcase. 22 is a cooling water path formed at the cylinder block 20A and 20B. 23A and 23B are a pair of engine beds. 24 is a through bolt by which the cylinder blocks 20A and 20B are connected to the engine beds 23A and 23B. 25 is a nut. L1 through L4 and R1 through R4 are a cylinder. The cylinder blocks 20A and 20B are connected to each other by a through bolt 24 via a pair of engine beds 23A and 23B, and a bidirectional type piston body 1 is accommodated reciprocatably in the X direction, which is the axial direction of the piston, in each of the four crankcases 21 formed therein.

Next, a description will be given of the cylinder block.

In FIG. 8 or FIG. 9, 26 is a cylinder wall of the cylinder blocks 20A and 20B. 27 is a through bolt hole into which the through bolt 24 is inserted.

In each of the crankcases 21 partitioned by the cylinder walls 26 of the cylinder block 20A (since the cylinder block 20B is identical to the cylinder block 20A, the illustration thereof is omitted), cylinders L1 through L4 formed to be larger than the width of the crankcase 21 at such a size where the pistons 2A and 2B are slidably accommodated, are juxtaposed. Thus, since the cylinders can be formed to be larger than the crankcase, it is possible to obtain a greater output while being compact.

Next, a description will be given of the engine bed.

In FIG. 10 or FIG. 11, 21 is a crankcase. 23A is an engine bed. 28 is a bearing part at which the crankshaft 12 formed at the engine beds 23A and 23B is disposed. 29 is an engine bed wall where the crankcase 21 is connected to the cylinder wall 26. 30 is a through bolt hole into which the through bolt 24 is inserted.

The engine beds 23A and 23B have a bearing part 28 for the crankshaft 12 at the central part of the two divisions thereof (Since the engine bed 23B is identical to the engine bed 23A, the description thereof is omitted).

Next, the crankshaft will be described below.

As shown in FIG. 12, the crankshaft 12 has four crank pins 11 bridged between the crank arms 13, wherein the crank pins 11 at both ends of the crankshaft are disposed 180° apart from the two crank pins 11 at the middle part of the crankshaft 12.

A description will be given of the assembling method of a bidirectionally reciprocating piston engine according to the first preferred embodiment, which is constructed as described above.

A rotating slider 10 is attached to each of the crank pins 11 of the crankshaft 12 with a bolt 15 and a nut 16. After the crankshaft 12 is disposed at the bearing part 28 of the engine bed 23A or 23B, the same is pressed by another engine bed 23B or 23A, thereby causing the engine beds 23A and 23B to be provisionally clamped. Next, all the pistons 2A and 2B are formed by inserting a bolt 5 into the connection parts 4A and 4B and tightening the same with a nut 6 in such a state where the part piston bodies 1A and 1B are opposed to each other and brought face to face together and a rotating slider 10 is put therebetween. Next, the cylinder blocks 20A and 20B are connected to each other by a through bolt 24 and a nut 25 via a pair of engine beds 23A and 23B so that the bidirectional type piston body 1 is covered from the outside.

The reason why the engine beds 23A and 23B are set before attaching the pistons 2A and 2B is that since usually the diameter of the pistons 2A and 2B is larger than the width of the crankcase 21 of the engine beds 23A and 23B, the engine beds 23A and 23B can not be attached if the pistons 2A and 2B are firstly attached.

Herein, in this preferred embodiment, although the cylinder block is connected to the engine bed by a bolt-nut structure, they may be connected by other conventional methods.

Furthermore, with respect to gas sealing and lubrication which are important factors for the engine, a bidirectionally reciprocating piston engine according to the preferred embodiment has functions equivalent to those of the existing reciprocating piston engines. That is, the gas sealing thereof completely equivalent to that of the conventional engines can be obtained. Since the relative speed between the piston slideway and rotating slider is equivalent to the relative speed between the conventional connecting rod and crank pins, a conventional technology can be utilized with respect to the lubrication thereof.

A description will be given of the motions of an 8-cylinder bidirectionally reciprocating piston engine according to the second preferred embodiment, which is constructed as described above.

As shown in FIG. 6 and FIG. 7, the pistons 2A and 2B of the four bidirectional type piston bodies 1 are regulated in the orthogonal direction crossing the axial line a of the crankshaft 12 by each of the corresponding cylinders L1 through L4 and R1 through R4, whereby as in the first preferred embodiment, the reciprocations of the pistons 2A and 2B are converted to rotating motions of the crankshaft 12 or the rotating motions of the crankshaft 12 are converted to reciprocations of the pistons 2A and 2B.

Furthermore, since the crank pins 11 are disposed as shown in FIG. 12, the opposed piston bodies 1 of the cylinders L1–R1 and L4–R4 move in the same cycle, and the opposed piston bodies of the cylinders L2–R2 and L3–R3 act with a half cycle delayed.

Next, a description will be given of the acting strokes.

Pistons 2A and 2B disposed in each of the cylinders L1 through L4 and cylinders R1 through R4 are positioned as shown in FIG. 7, the strokes in the cylinders L1 through L4 and cylinders R1 through R4 are as follows:

When the cylinder L1 is in the beginning of exhaust, the cylinder R1 is in the beginning of suction, when the cylinder L2 is in the beginning of suction, the cylinder R2 is in the beginning of exhaust, when the cylinder L3 is in the beginning of explosion, the cylinder R3 is in the beginning of compression, and when the cylinder L4 is in the beginning of compression,the cylinder R4 is in the beginning of explosion.

As a result, a left side piston is ignited so that the same makes an explosion simultaneously with the right piston attached to the crank pin adjacent thereto.

Therefore, left and right pistons 2A and 2B will make an explosion simultaneously at both the left and right sides at every half cycle in the following sequence.

1) L3 and R4 are exploded.
2) L4 and R3 are exploded.
3) L2 and R1 are exploded.
4) L1 and R2 are exploded.

As described above, according to an 8-cylinder bidirectionally reciprocating piston engine according to the above-mentioned preferred embodiments, since the cylinder block is constructed via a pair of engine beds, it is possible to manufacture an 8-cylinder piston engine with bidirectional type piston bodies only put therebetween when assembling. Therefore, it is easy to assemble the engine, and the productivity thereof can be remarkably increased. Furthermore, since one piston makes an explosion simultaneously with the other opposed piston disposed at a 180° slipped relationship at the crank pin via at least one side wall of the cylinder wall and engine bed wall, the impact produced by explosion and influenced upon the bearing part of the crankshaft can be counterbalanced. Therefore, it is possible to decrease the mechanical damage of the bearing part to a large extent.

With the invention, the following excellent effects and advantages can be achieved by a bidirectionally reciprocating piston engine according thereto.

(1) Since a bidirectional type piston body is caused to reciprocate in cylinders opposed each other with the axial center of the piston body coincident with that of the cylinders via a rotating slider attached to the crank pin and disposed at the crank drive part formed at the arm part of the piston bases disposed opposite to each other, the piston motions do not contain any harmonic components, wherein only the fundamental frequency is permitted. Therefore, it is possible to greatly decrease the vibrations, thereby causing the noise to be suppressed to a low level.

(2) No connecting rod nor piston pin is required and the piston is brought into contact with the peripheral wall of the corresponding cylinder at two points at both ends of a piston, the distance therebetween being made longer in comparison with the piston stroke, no piston guide bearing is required. Thereby, the number of components can be remarkably decreased, and the productivity and working efficiency can be highly increased. Therefore, the production cost is able to be suppressed, and the mass production efficiency will be improved.

(3) In a case where the bidirectionally reciprocating piston engine is applied to an 8-cylinder bidirectionally reciprocating piston engine, a completely dynamic balance can be secured, and the explosion force acts on the crankshaft as a couple simultaneously from two pistons, it is possible to reduce the mechanical loss of the bearing part.

(4) In comparison with a series 4-cylinder or 6-cylinder internal combustion engine in which a conventional connecting rod is used, since the number of pistons per crank pin can be doubled, the displacement of an internal combustion engine is able to be increased at a low cost and with a remarkably simple structure.

(5) In a case where the displacement is the same, the explosion may be half the conventional explosion force, and a force is applied to the crankshaft as a rotating torque of a couple from two points. Therefore, the stress is dispersed to thereby cause the mechanical stress of the crank pin, crank arm and bearing part of the crankshaft to be remarkably decreased.

(6) Furthermore, since one crank pin is provided with two pistons, it is possible to take out a force which is two times a case where a conventional crankshaft is provided with one piston per crank pin. The bidirectionally reciprocating piston engine according to the invention is made very compact, and a high output can be secured. This is especially effective for a large-capacity engine.

(7) Since no conventional piston pin is required in the respective pistons, a freedom of designing the shape of the piston top in order to improve the thermal transmission is improved, thereby the thermal countermeasure is made easier. This is especially effective for a large-capacity engine.

(8) Since it is possible to horizontally dispose pistons, the height of an internal combustion engine can be lowered, whereby the range of application of internal combustion engines can be widened.

(9) Since it is easy to multiply the number of cylinders and possible to greatly decrease the force applied to the crank bearing, it is possible to increase or improve the output and durability of not only engines for vehicles but also large-sized internal combustion engines for vessels and/or co-generation plants.

While a principle of the present invention has been described above in connection to preferred embodiments of the invention, it is intended that all matter contained in the above description and illustrated in the accompanying drawings shall be interpreted to be illustrative and a limiting sense.

What is claimed is:

1. A bidirectionally reciprocating piston engine comprising:

a pair of cylinder blocks each having a cylinder and disposed opposite to each other to form at least part of a crankcase at the base of said cylinders;

a bidirectional type piston body having a pair of pistons each accommodated in a corresponding one of said cylinders of said cylinder blocks with the pistons disposed opposite to each other and with the axial line of said piston body coincident with that of said cylinders, and a pair of arms each integral with a base of a corresponding one of said pistons, a crank drive part being formed at a central part of said piston body by opposing parts of said arms and providing an elongated hole;

a rotating slider slidably disposed in the elongated hole of said crank drive part; and a crankshaft having a crank pin to which the rotating slider is rotatably attached.

2. A bidirectionally reciprocating piston engine as set forth in claim 1, wherein the phase of at least one crank pin adjacent to another crank pin has a configuration different by 180° (degrees) from said another crank pin.

3. A bidirectionally reciprocating piston engine as set forth in claim 1, wherein said cylinder blocks disposed opposite to each other are connected together via a pair of engine beds having a bearing part for receiving said crank shaft.

4. A bidirectional reciprocating piston engine as set forth in claim 1, wherein the diameter of each of said pistons is larger than the width of said crank case.

5. A bidirectional reciprocating piston engine as set forth in claim 1, wherein said crank shaft has four crank pins each abridged between a pair of crank arms, wherein two of said crank pins are in line with each other at opposite ends of said crank shaft and the other two crank pins are in line with and adjacent to each other at a middle part of said crank shaft, and wherein said two end cranks shafts are disposed 180° apart from said two middle cranks shafts.

6. A bidirectionally reciprocating piston engine as set forth in claim 3, wherein the phase of at least another crank pin adjacent to one crank pin has a configuration different by 180° (degrees) from said another crank pin.

7. A bidirectional reciprocating piston engine as set forth in claim 1, wherein each of said arms comprises at least one integral connection part secured to the at least one integral connection part of the other arm to connect to each other a pair of part piston bodies each comprising one of said arms integral with one of said pistons.

8. A bidirectional reciprocating piston engine as set forth in claim 7, wherein each of said arms comprises two of said connection parts extending opposite to each other along opposite ends of the elongated hole of said cranks drive part.

* * * * *